US005244766A

United States Patent [19]

Houle et al.

[11] Patent Number: 5,244,766

[45] Date of Patent: Sep. 14, 1993

[54] HALOGENATED RESINS FOR LIQUID DEVELOPERS

[75] Inventors: William A. Houle, Flat Rock, N.C.; Steven P. Schmidt, Chester Springs, Pa.

[73] Assignee: Xerox Corporation, Stamford, Conn.

[21] Appl. No.: 801,226

[22] Filed: Dec. 3, 1991

[51] Int. Cl.[5] ..... G03G 9/13

[52] U.S. Cl. ..... 430/114; 430/116

[58] Field of Search ..... 430/114, 116

[56] References Cited

U.S. PATENT DOCUMENTS

| | | | |
|---|---|---|---|
| 3,761,413 | 9/1973 | Hulse | 252/62.1 |
| 3,852,208 | 12/1974 | Nagashima et al. | 252/62.1 |
| 3,880,689 | 4/1975 | Rolker et al. | 156/233 |
| 3,933,664 | 1/1976 | Nagashima et al. | 252/62.1 |
| 4,113,641 | 9/1978 | Brana et al. | 252/62.1 |
| 4,139,483 | 2/1979 | Williams et al. | 252/62.1 |
| 4,248,954 | 2/1981 | Datta et al. | 430/97 |
| 4,268,598 | 5/1981 | Leseman et al. | 430/107 |
| 4,388,396 | 6/1983 | Nishibayashi et al. | 430/126 |
| 4,468,446 | 8/1984 | Mikami et al. | 430/138 |
| 4,524,119 | 6/1985 | Luly et al. | 430/108 |
| 4,592,988 | 6/1986 | Aldrich et al. | 430/107 |
| 4,684,596 | 8/1987 | Bonser et al. | 430/110 |
| 4,797,341 | 1/1989 | Tsubuko | 430/114 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,030,667 | 7/1991 | Shimizu et al. | 523/201 |
| 5,034,299 | 7/1991 | Houle et al. | 430/115 |

*Primary Examiner*—John Goodrow
*Attorney, Agent, or Firm*—Oliff & Berridge

[57] ABSTRACT

A liquid electrostatic developer includes a toner which is made from a halogenated resin, a thermoplastic resin and a colorant. Preferably the halogenated resin is a fluorinated resin. Optionally, a charge adjuvant may be present. The liquid electrostatic developer is prepared by a process wherein the halogenated resin, the thermoplastic resin, the optional colorant and the optional charge adjuvants are melt blended to form a mixture. This mixture is ground at a cold temperature, and subsequently charged with a charge director. The toner used in the liquid electrostatic developer formed by this process has excellent thermoplastic and electrical properties and provides a developer with excellent imaging characteristics.

24 Claims, No Drawings

HALOGENATED RESINS FOR LIQUID DEVELOPERS

This invention is directed to a liquid developer and in particular, to a liquid developer containing a toner comprising a halogenated resin, and a method for making the same.

BACKGROUND OF INVENTION

A latent electrostatic image can be developed with toner particles dispersed in an insulating non-polar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by the colored toner particles dispersed in the non-polar liquid. The image may then be transferred to a receiver sheet.

Useful liquid developers comprise a thermoplastic resin and a dispersant non-polar liquid. Generally, a suitable colorant, such as a dye or pigment, is also present. The toner particles are dispersed in the non-polar liquid which generally has a high volume resistivity in excess of $10^9$ ohm-centimeters, a low dielectric constant (i.e. below 3.0) and a high vapor pressure. Generally, the toner particles have a particle size range of 0.01 to less than 10 μm, and have an average by area particle size of less than 10 μm as measured by the Horiba CAPA-500 centrifugal automatic particle analyzer, manufactured by Horiba Instruments, Inc., Irvine, Calif. (solvent viscosity of 1.24 cps; solvent density of 0.76 g/cc; sample density of 1.32 using a centrifugal rotation of 1,000 rpm), and an average by area particle size of less than 30μm as measured by a Malvern 3600E Particle Sizer, manufactured by Malvern, Southborough, Mass.

The Malvern 3600E Particle Sizer uses laser diffraction light scattering of stirred samples to determine average particle sizes. Because the Horiba and Malvern instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 5 | 0.2 ± 0.6 |

The correlation is obtained by statistical analysis of average particle sizes for 67 liquid electrostatic developer samples (not of this invention) obtained on both instruments. The expected range of Horiba values was determined using a linear regression at a confidence level of 95%.

Because the formation of proper images depends on the difference of the charge between the liquid developer and the latent electrostatic image to be developed, it has been found desirable to add a charge director compound and preferably other adjuvants which increase the magnitude of the charge (e.g., polyhydroxy compounds, aminoalcohols, polybutylene succinimide compounds, aromatic hydrocarbons, metallic soaps, etc.) to the liquid developer comprising the thermoplastic resin, the non-polar liquid and the colorant. The properties of the toner particles are critical to the optimal electrical functioning of the liquid electrostatic developer and the production of good quality images.

U.S. Patent No. 5,019,477 to Felder discloses a liquid electrostatic developer comprising a non-polar liquid, thermoplastic resin particles, and a charge director. The thermoplastic resin particles comprise a mixture of (1) a polyethylene homopolymer or a copolymer of (i) polyethylene and (ii) acrylic acid, methacrylic acid or alkyl esters thereof, wherein (ii) comprises 0.1–20 weight percent of the copolymer; and (2) a random copolymer of (iii) selected from the group consisting of vinyltoluene and styrene and (iv) selected from the group consisting of butadiene and acrylate. As the copolymer of polyethylene and methacrylic acid or methacrylic acid alkyl esters, Nucrel® may be used.

U.S. Pat. Nos. 3,852,208 and 3,933,664, both to Nagashima et al., disclose colored, light-transparent photoconductive material which is obtained by a condensation reaction of organic photoconductive substances with reactive colored components. The chemical combination of an organic photoconductive substance having at least one amino or hydroxyl group with a color development component having at least one active halogen atom produces the color developing organic photoconductive materials. Alternatively, the color developing materials can be obtained from the chemical combination of an organic photoconductive substance having at least one active halogen atom with a color developing component having at least one amino or hydroxyl group. The color developing organic photoconductive material may be pulverized in a ball-mill, a roll-mill or an atomizer to produce a toner for use as a dry or wet developing agent, or may be used in combination with other colored substances or vehicle resins.

U.S. Pat. No. 4,524,119 to Luly et al. discloses electrophotographic development carrier particles for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 to Tsubuko et al. discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid-repelling and solvent-soluble properties.

U.S. Pat. No. 5,030,535 to Drappel et al. discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C.–120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 4,797,341 to Tsubuko discloses a liquid two toner component developer system. The first component is small particles of toner resin containing a dye or pigment. The resins disclosed for the first component are copolymers of alkyl acrylates or methacrylates and divinylbenzene or its alkyl derivatives. Optionally, other monomers may also be present. The second component consists of larger particles of a pure polytetrafluoroethylene (PTFE) resin and a colorant. The larger particles act as carriers for the smaller particles.

U.S. Pat. No. 3,761,413 to Hulse discloses a dry xerographic toner composition consisting of a mixture of resinous particles having a colorant uniformly dispersed in the particle and a small amount of finely divided polytetrafluoroethylene or of finely divided copolymer of tetrafluoroethylene and hexafluoropropylene. The toner composition is prepared by polymerization. Molecular weight range and melt index range are controlled by adjusting the amount of polymerization initiator and the temperature employed in the polymerization.

SUMMARY OF THE INVENTION

It is an object of the present invention to provide a liquid electrostatic developer with excellent imaging characteristics.

It is a further object of the invention to provide a liquid electrostatic developer with high toner particle mobility, short equilibration times and no evidence of toner of the opposite charge.

It is yet a further object of the invention to provide a liquid electrostatic developer with reduced dependence of toner properties on other ingredients such as pigments or charge control adjuvants.

These and other objects are achieved by a liquid developer which includes a liquid carrier and a toner comprised of a halogenated (preferably fluorinated) resin, a thermoplastic resin, a colorant (preferably a pigment), and an optional charge control adjuvant. Additionally, the invention provides a method for preparing the toner by a process comprising the steps of melt blending a halogenated resin, a thermoplastic resin, a colorant and an optional charge control adjuvant to form a mixture; grinding the mixture at a cold temperature to form toner particles; dispersing the toner particles in a liquid carrier; and charging the toner particles with a charge director.

The toner employed in the liquid developer of the invention has the additional advantageous properties of being soft or molten at elevated temperatures and of being capable of being ground at low temperatures.

DETAILED DESCRIPTION OF PREFERRED EMBODIMENTS

The present invention provides a liquid developer which includes a toner comprised of a halogenated resin, a thermoplastic resin, a colorant and an optional charge adjuvant, and a carrier liquid used as a dispersion medium. Preferably, a fluorinated resin is employed as the halogenated resin. The liquid developer of the invention may also contain charge director compounds and other adjuvants. The carrier liquid is preferably a non-polar liquid having a kauri-butanol value of less than 30. The toner of the present invention is substantially insoluble in the carrier liquid.

The invention also provides a method for preparing a liquid electrostatic developer of the invention by a process comprising the steps of melt blending a halogenated resin, a thermoplastic resin, a pigment and an optional charge adjuvant to form a mixture; grinding the mixture at a cold temperature to form toner particles; dispersing the toner in a liquid carrier; and charging the toner particles with a charge director.

The thermoplastic resin-halogenated resin particles used in the invention are single particles composed of halogenated resin particles partially coated with a thermoplastic resin. The halogenated resin of the invention may be any resin containing one or more halogen atoms, including mixtures of halogen atoms, and is preferably a fluorinated resin selected from the group consisting of polytetrafluoroethylene, poly(tetrafluoroethylene-co-chlorotrifluoroethylene), poly(tetrafluoroethylene-co-hexafluoropropylene, poly(tetrafluoroethylene-co-perfluoroalkylether), poly(tetrafluoroethylene-co-ethylene), polyvinylidinefluoride, polychlorotrifluoroethylene, poly(chlorotrifluoroethylene-co-ethylene) and polyvinylfluoride, chlorinated polyethylene. Other preferred halogenated resins include chlorosulfonated polyethylene, polyvinylchloride and copolymers such as polyvinylchloride-co-vinyl acetate, polyvinylchloride-co-ethylene, polyvinylchloride-co-propylene, polyvinylchloride-co-acetate, and chlorinated polyvinylchloride, and most preferably polytetrafluoroethylene (PTFE). In a preferred embodiment, single particles composed of a polytetrafluoroethylene-hydrocarbon resin blend in the same particle are employed. The toner particles formed have an average by area particle size of less than 30 μm, and preferably less than 10 μm, as measured by the Malvern 3600E Particle Sizer. (In the claims appended to this specification, the particle size values are measured using the Malvern 3600E Particle Sizer.)

The thermoplastic resin-halogenated resin particle formed of these materials possesses the desirable combination of a resin particle with both optimal thermoplastic properties and charging properties needed to form good quality images. The formation of proper images depends on the difference of the charge between the toner particles and the latent electrostatic image to be developed. In the developer of the invention, the halogenated resin provides the desired electrical properties needed with respect to charging the toner particles in order to develop an electrostatic image with good quality. The thermoplastic resins employed in the present invention are selected to provide the necessary melt properties of the toner particles of being soft and molten at elevated temperatures (e.g., greater than 100° C.) and yet capable of being ground at low temperatures. In particular, the resin must fuse at temperatures >70° C., solvate (i.e. become swollen or gelatinous) at temperatures >50° C., and be capable of being ground at temperatures <40° C.

The thermoplastic resins employed in the liquid developer of the present invention include ethylene vinyl acetate (EVA) copolymers (Elvax®resins, E. I. du Pont de Nemours and Company, Wilmington, Del.); copolymers of ethylene and an α-β-ethylenically unsaturated acid selected from the group consisting of acrylic acid and methacrylic acid; copolymers of ethylene (80–99.9%), acrylic or methacrylic acid (20 to 0.1%)/alkyl ($C_l$ to $C_5$) ester of methacrylic or acrylic acid (0.1 to 20%); polyethylene; polystyrene; isotactic polypropylene (crystalline); ethylene ethyl acrylate series sold under the trademark Bakelite® DPD 6169, DPDA 6182 Natural (Union Carbide Corp., Stamford, Conn.); ethylene vinyl acetate resins, e.g., DQDA 6832 Natural 7 (Union Carbide Corp.); Surlyn® ionomer resin (E. I. du Pont de Nemours and Company, Wilmington, Del.); etc., or blends thereof; polyesters; polyvinyl toluene; polyamides; styrene/butadiene copolymers; epoxy resins; acrylic resins such as a copolymer of acrylic or methacrylic acid and at least one alkyl ester of acrylic or methacrylic acid wherein alkyl is 1 to 20 carbon atoms, e.g., methyl methacrylate (50 to 90%)/methacrylic acid (0 to 20%/ethylhexyl acrylate (10 to 50%); and other acrylic resins including Elvacite® Acrylic Resins (E. I. du Pont de Nemours and Company); or blends of the resins. Preferred copolymers are the copolymer of ethylene and an α-β-ethylenically unsaturated acid of either acrylic acid or methacrylic acid. Preferably, it is a PTFE/methacrylic acid resin. In a preferred embodiment, Nucrel® is used as the thermoplastic resin.

The thermoplastic resin particles partially coat the halogenated resin particles in such a manner that portions of the halogenated resin particles are covered by the thermoplastic resin to varying thicknesses and other portions remain exposed. The halogenated resin is present in the toner particle in an amount of about 10 to about 70 percent by weight, preferably about 20 to about 50 percent by weight. The thermoplastic resin-halogenated resin particles of the developer comprise about 50–99 percent, and preferably about 70–80 percent by weight of the total solids content (e.g., resin, colorant and adjuvants) of the liquid developers of the present invention.

The toner particles of the present invention may contain a colorant dispersed in the resins. Colorants, such as pigments or dyes and combinations thereof, are preferably present to render the latent image visible.

The colorant may be present in the toner particles in an amount of from about 0.1 to about 60 percent, and preferably from about 1 to about 30 percent by weight based on the total weight of solids contained in the developer. The amount of colorant used may vary depending on the use of the developer. Examples of pigments which may be used in the present developers include those set forth below.

| Pigment Brand Name | Manufacturer | Color |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chem. | Yellow 14 |
| L75-1331 Yellow | Sun Chem. | Yellow 17 |

-continued

| Pigment Brand Name | Manufacturer | Color |
|---|---|---|
| Hansa Yellow RA | Hoechst | Yellow 73 |
| Hansa Brilliant Yellow 5GX-02 | Hoechst | Yellow 74 |
| Dalamar® Yellow YT-858-D | Heubach | Yellow 74 |
| Hansa Yellow X | Hoechst | Yellow 75 |
| Novoperm® Yellow HR | Hoechst | Yellow 83 |
| L75-2337 Yellow | Sun Chem. | Yellow 83 |
| Cromophthal® Yellow 3G | Ciba-Geigy | Yellow 93 |
| Cromophthal® Yellow GR | Ciba-Geigy | Yellow 95 |
| Novoperm® Yellow FGL | Hoechst | Yellow 97 |
| Hansa Brilliant Yellow 10GX | Hoechst | Yellow 98 |
| Lumogen® Light Yellow | BASF | Yellow 110 |
| Permanent Yellow G3R-01 | Hoechst | Yellow 114 |
| Cromophthal® Yellow 8G | Ciba-Geigy | Yellow 128 |
| Irgazine® Yellow 5GT | Ciba-Geigy | Yellow 129 |
| Hostaperm® Yellow H4G | Hoechst | Yellow 151 |
| Hostaperm® Yellow H3G | Hoechst | Yellow 154 |
| Hostaperm® Orange GR | Hoechst | Orange 43 |
| Paliogen® Orange | BASF | Orange 51 |
| Irgalite® Rubine 4BL | Ciba-Geigy | Red 57:1 |
| Quindo® Magenta | Mobay | Red 122 |
| Indofast® Brilliant Scarlet | Mobay | Red 123 |
| Hostaperm® Scarlet GO | Hoechst | Red 168 |
| Permanent Rubine F6B | Hoechst | Red 184 |
| Monastral® Magenta | Ciba-Geigy | Red 202 |
| Monastral® Scarlet | Ciba-Geigy | Red 207 |
| Heliogen® Blue L 6901F | BASF | Blue 15:2 |
| Heliogen® Blue TBD 7010 | BASF | Blue:3 |
| Heliogen® Blue K 7090 | BASF | Blue 15:3 |
| Heliogen® Blue L 7101F | BASF | Blue 15:4 |
| Heliogen® Blue L 6470 | BASF | Blue 60 |
| Heliogen® Green K 8683 | BASF | Green 7 |
| Heliogen® Green L 9140 | BASF | Green 36 |
| Monastral® Violet | Ciba-Geigy | Violet 19 |
| Monastral® Red | Ciba-Geigy | Violet 19 |
| Quindo® Red 6700 | Mobay | Violet 19 |
| Quindo® Red 6713 | Mobay | Violet 19 |
| Indofast® Violet | Mobay | Violet 19 |
| Monastral® Violet Maroon B | Ciba-Geigy | Violet 42 |
| Sterling® NS Black | Cabot | Black 7 |
| Sterling® NSX 76 | Cabot | |
| Tipure® R-101 | Du Pont | White 6 |
| Mogul L | Cabot | Black, CI 77266 |
| Uhlich® BK 8200 | Paul Uhlich | Black |

In order to increase the toner particle charge and, accordingly, increase the mobility and transfer latitude of the toner particles, charge adjuvants may also be added to the toner particles. For example, negative charge adjuvants, such as metallic soaps (i.e., aluminum or magnesium stearate or octoate) and fine particle size oxides (such as oxides of silica, alumina, titania, etc.) may be added in the case of producing a developer containing negatively chargeable toner particles, and positive charge adjuvants, such as para-toluene sulfonic acid, and polyphosphoric acid, may be added when producing a developer containing positively chargeable toner particles. Negative charge adjuvants increase the negative charge of a toner particle, while the positive charge adjuvants increase the positive charge of the toner particles. The charge adjuvants are added to the present toner particles in an amount of from about 1 to about 1000 mg/g and preferably from about 5 to about 60 mg/g of the total weight of solids contained in the developer.

Examples of the above-noted metallic soaps are aluminum stearate; aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthanates; calcium, cobalt, manganese, lead and zinc resinates, etc.

Other negative charge adjuvants which may be used in the present toner particles are the polyhydroxy compounds, i.e., those which contain at least two hydroxy groups and polybutylene/succinimide compounds. These adjuvants may also be used in amounts of from about 1 to 1,000 mg/g, and preferably from about 5 to 60 mg/g, of the total amount of solids contained in the developer.

Examples of these compounds are as follows:

I) Polyhydroxy compounds include ethylene glycol; 2,4,7,9-tetramethyl-5-decyn-4,7-diol; poly(propylene glycol); pentaethylene glycol; tripropylene glycol; triethylene glycol; glycerol; pentaerythritol; glycerol-tri-12 hydroxystearate; ethylene glycol monohydroxy-stearate, propylene glycerol monohydroxy-stearate, etc.

II) Polybutylene/succinimide compounds include OLOA ®-1200 by Chevron Corp. and Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, with the remainder being oil.

The non-polar liquid used as the dispersion medium has a kauri-butanol value of less than about 30 and is preferably a branched-chain aliphatic hydrocarbon. A non-polar liquid of the Isopar ® series (manufactured by Exxon Corporation) may be used in the present developers. These hydrocarbon liquids are narrow cuts of isoparaffinic hydrocarbon fractions with extremely high levels of purity. For example, the boiling range of Isopar ®G is between 157° C. and 176° C.; Isopar ®H is between about 176° C. and 191° C.; Isopar ®K is between about 177° C. and 197° C.; Isopar ®L is between 188° C. and 206° C.; Isopar ®M is between 207° C. and 254° C.; and Isopar ®V is between 254.4° C. and 329.4° C. Isopar ®L has a mid-boiling point of approximately 194° C. Isopar ®M has an auto ignition temperature of 338° C. Isopar ®G has a flash point of 40° C. as determined by the tag closed cup method; Isopar ®H has a flash point of 53° C. as determined by the ASTM D-56 method; Isopar ®L has a flash point of 61° C. as determined by the ASTM D-56 method and Isopar ®M has a flash point of 80° C. as determined by the ASTM D-56 method.

All of the non-polar liquids in the present invention should have an electrical volume resistivity in excess of $10^9$ ohms/centimeter and a dielectric constant below 3.0. Moreover, the vapor pressure at 25° C. should be less than 10 torr.

While the Isopar ® series are the preferred non-polar liquids for use as dispersants in the present liquid developers, the essential characteristics of all suitable non-polar liquids is the kauri-butanol value. Specifically, the non-polar liquids employed in the present liquid electrostatic developers have a kauri-butanol value of about 25 to about 30, and preferably about 27 to 28, as determined by the ASTM D-1136 method.

The kauri-butanol value can be defined as a measure of the aromatic content (and hence, the solvent power) of a hydrocarbon liquid. The kauri-butanol value is a measure of the volume of solvent required to produce turbidity in a standard solution containing kauri gum dissolved in butanol. Kauri gum is readily soluble in butanol but insoluble in hydrocarbons. Accordingly, low kauri-butanol values represent non-polar aliphatic solvents with high dielectric constants and low volume resistivities.

The amount of the non-polar liquid employed in the developer of the present invention is about 85–99.9 and preferably 97–99.5 percent by weight of the total liquid developer. The total solids content of the present developers is 0.1–15 and preferably 0.5–3 percent by weight.

The liquid developer of this invention may include a charge director to impart a charge to the toner particles sufficient to enable the particles to undergo electrophoresis in an electric field through the insulating organic liquid dispersion medium. The charge director should be soluble in the non-polar liquid. Exemplary charge directors in the developers of this invention may include ionic and zwitterionic charge directors such as lecithin, Basic Calcium Petronate ®, Basic Barium Petronate ®, Neutral Barium Petronate, oil-soluble petroleum sulfonate (manufactured by Sonneborn Division of Witco Corp., New York, N.Y.); alkyl succinimide (manufactured by Chevron Chemical Company of California), etc.; sodium dioctylsulfo succinate (manufactured by American Cyanamid Co.); ionic charge directors such as zirconium octoate, copper oleate, iron naphthenate, etc.; nonionic charge directors, e.g., polyethylene glycol sorbitan stearate, nigrosine, triphenyl methane type dyes and Emphos ®D70 -30C., and Emphos ®F-27-85 (sold by Witco Corp.); sodium salts of phosphated mono- and diglycerides with unsaturated and saturated acid substituents, respectively.

The charge director compounds may be used in amounts of 0.25 to 1500 mg of charge director per gram of toner solid, and preferably 2.5 to 400 mg of charge director per gram of toner solid.

The liquid developer of the invention may be produced by mixing together in a non-polar liquid having a kauri-butanol value of less than 30, a thermoplastic resin, a halogenated resin, a colorant and an optional charge control adjuvant. The liquid developer may be prepared in a suitable mixing or blending vessel, e.g., an attritor, a heated ball mill, or a heated vibratory mill. The mixture is heated to a temperature from about 60° C. to about 120° C. until a uniform dispersion is formed. Additional amounts of non-polar liquid may be added sufficient to decrease the total solids concentration of the developer to about 5 to 40 percent by weight. The dispersion is then cooled to about 0° C. to about 50° C., and a charge director is added to the dispersion which is soluble in the non-polar liquid. The dispersion is then diluted to working strength.

In particular, to prepare the initial mixture, the resins are added separately to an appropriate vessel with enough non-polar liquid to provide a dispersion of about 15–40 percent solids. The mixture is subjected to elevated temperatures during an initial mixing procedure in order to plasticize and soften the resins. The mixture must be sufficiently heated to provide a uniform dispersion of all solid materials (e.g. colorant, adjuvant and resins). However, the temperature at which this step is undertaken must not be so high as to degrade the non-polar liquid or decompose the resins or colorant. Accordingly, the mixture is heated to a temperature of from about 80° C. to 120° C. It is during this step of the process that the thermoplastic resin partially coats the halogenated particles to form the toner particles of the invention.

The dispersion is then cooled to about 0° C. to about 50° C., and preferably to about 15° C. to about 30° C., while mixing is continued, until the resin admixture solidifies or hardens. Upon cooling, the resin admixture precipitates out of the dispersant liquid. Cooling is accomplished by means known to those skilled in the art such as, for example, gravity feed methods, vacuum filtration methods, etc. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding (e.g., by means of particulate media); or with stirring to form a viscous mixture and grinding by means of particulate media. The resin precipitate is cold ground for about 1 to 36 hours, and preferably 2–6 hours. Additional liquid may be added at any step during the preparation of the liquid developer to facilitate grinding or to dilute the developer to the appropriate percent solids needed for developing.

A charge director of the invention is then added to the mixture of resin and liquid carrier to impart a positive or negative charge to toner particles in the developer, as desired, optionally in a small amount of the liquid carrier. The addition may occur at any time during the process after cooling, but preferably is performed at the end of the procedure, i.e., after separation. If a diluting non-polar liquid is also added to reduce the concentration of toner particles in the dispersion, the charge director compound may be added prior to, concurrently with, or subsequently to the addition of non-polar liquid. The charge director compound may be added in amounts of 0.25 to 1200 mg of charge director per gram of toner solid, and preferably 2.5 to 400 mg of charge director per gram of toner solid.

In order to facilitate handling of the developer, the concentration of toner particles in the dispersion may be reduced by the further addition of non-polar liquid. The dilution is normally conducted to reduce the concentration of toner particles to between 0.1 to 15%, and preferably to between 0.5 to 3%. Although the dilution step may be carried out after the charge is imparted to the developer, the sequence of these steps is not critical.

The invention will further be illustrated in the following non-limiting examples, it being understood that these examples are intended to be illustrative only and that the invention is not intended to be limited to the materials, conditions, process parameters and the like recited herein.

Control Preparation 1

In a Union Process IS attritor (Union Process Company, Akron, Ohio) are place the following ingredients: 288.9 grams of copolymer of ethylene (91%) and methacrylic acid (9%) (Acid Number 54), 32.1 grams lithol scarlet pigment NBD 4455 (BASF, Holland, Michigan), 1,284 grams Isopar ®L (Exxon Chemical Corporation). The ingredients are heated to 100° C. and milled for 1 hour with 0.1875 inch (4.76 mm) carbon steel balls. The mixture is cooled to ambient temperature, 535 grams of Isopar ®L are added, and the mixture is milled for four hours. An additional 535 grams of Isopar ®L are added and the mixture is separated from the carbon steel balls. The average by area particle size is 7.8 microns as measured with a Malvern 3600E particle size analyzer.

EXAMPLE PREPARATION 1

The procedure of Control Preparation 1 is followed with the following exceptions: 144.5 grams of polytetrafluoroethylene (MP1100, duPont Corporation, Wilmington, DE) are used, and only 144.5 grams of the copolymer of ethylene (91%) and methacrylic acid (9%) (Acid Number 54) are used. The particle size is 9.9 microns.

Control Preparation 2

The procedure of Control Preparation 1 is followed with the following exceptions: 32.1 grams of cyan pigment NBD 7010 (BASF Corporation, Holland, Michigan) is used in place of the lithol scarlet pigment NBD 4455. The particle size is 10.0 microns.

EXAMPLE PREPARATION 2

The procedure of Example Preparation I is followed with the following exception: 32.1 gram of cyan pigment NBD 7010 is used in place of the lithol scarlet pigment NBD 4455. The particle size is 9.9 microns.

Control Preparation 3

The procedure of Control Preparation 1 is followed with the following exception: 32.1 grams of magenta pigment Quindo Red R6713 (Mobay Corporation, Pittsburgh, PA) is used in place of the lithol scarlet pigment NBD 4455. The particle size is 11.3 microns.

EXAMPLE PREPARATION 3

The procedure of Example Preparation 1 is followed with the following exception: 32.1 grams of magenta pigment Quindo Red R6713 is used in place of the lithol scarlet pigment NBD 4455. The particle size is 15.1 microns.

Control Preparation 4

In a Union Process 01 attritor (Union Process Company, Akron, Ohio) are placed the following ingredients: 35 grams of copolymer of ethylene (91%) and methacrylic acid (9%) (Acid Number 54), 7 grams of black pigment Mogul ®L (Cabot Corporation, Boston, MA), and 180 grams Isopar ®L (Exxon Chemical Corporation).

The ingredients are heated to 100° C. and milled for 1 hour with 0.1875 inch (4.76 mm) carbon steel balls. The mixture is cooled to ambient temperature, milled for 8 hours and separated from the carbon steel balls. The particle size is 8.3 microns.

EXAMPLE PREPARATION 4

The procedure of Control Preparation 4 is followed with the following exceptions: 16.5 grams of polytetrafluoroethylene (Whitcon ® TL-5, LNP Plastics, Malvern, Pa.) is used and 16.5 grams of the copolymer of ethylene (91%) and methacrylic acid (9%) (acid number 54) is used. The particle size is 6.6 microns after milling at ambient temperature for 27 hours.

Control Preparation 5

In a Union Process 01 attritor (Union Process Company) are placed the following ingredients: 45 grams of a copolymer of ethylene (82%) and vinyl acetate (18%), (melt index is 136–165), and 200 grams of Isopar ® L (Exxon Chemical Corporation). The ingredients are heated to 100° C. and milled for 2.5 hour with 0.1875 inch (4.76 mm) carbon steel balls. The mixture is cooled to ambient temperature, milled for 17.5 hours and separated from the carbon steel balls. The particle size is 7.1 microns.

EXAMPLE PREPARATION 5

The procedure of Control Preparation 5 was followed with the following exceptions: 22.5 g of polytetrafluoroethylene (MP1100, duPont Corporation) are used, and 22.5 g of the copolymer of ethylene (82%) and vinyl acetate (18%) are used. The particle size is 3.7 microns.

Control Preparation 6

In a Union Process IS attritor (Union Process Company) are placed the following ingredients: 319 grams of copolymer of ethylene (91%) and methacrylic acid (9%) (acid number 54), 25 grams of a black pigment Mogul ® L (Cabot Corporation), and 1700 grams of Isopar ® L (Exxon Chemical Corporation). The ingredients are heated to 100° C. and milled for 1 hour with 0.1875 inch (4.76 mm) carbon steel balls. The mixture is cooled to ambient temperature and milled for 2 hours. An additional 1200 grams of Isopar ®L are added and the mixture separated from the carbon steel balls. The particle size is 7.8 microns.

EXAMPLE PREPARATION 6

The procedure of Control Preparation 6 is followed with the following exceptions: 85 grams of polytetrafluoroethylene (MP1100, duPont Corporation) are used, and 255 grams of the copolymer of ethylene (91%) and methacrylic acid (9%) are used. The particle size is 8.5 microns.

EXAMPLE 7

In a Union Process 1 S attritor (Union Process Company) are placed the following ingredients: 128 grams of copolymer of ethylene (91%) and methacrylic acid (9%) (acid number 54), 85 grams of a black pigment Mogul ® L (Cabot Corporation), 213 grams of polytetrafluoroethylene (MP1100, duPont Corporation), and 1,700 grams of Isopar ® L (Exxon Chemical Corporation). The ingredients are heated to 100° C. and milled for 1 hour with 0.1875 inch (4.76 mm) carbon steel balls. The mixture is cooled to ambient temperature and milled for 2 hours. 800 grams of Isopar ® L are added and the mixture is separated from the carbon steel balls. The particle size is 6.2 microns.

Scanning electron micrographs are made of the resultant toner particles and compared to micrographs of the pure polytetrafluoroethylene (PTFE) resin and to toner particles with only the ethylene/methacrylic acid resin (Control Preparation 4). The PTFE particles are smooth and have regular shapes approaching spherical. The particles of Control Preparation 4 have irregular shapes with rough surfaces containing protrusions, nodules and bridges between particles. The toner particles from this example (Example 6) look identical to the particles of Control Preparation 4, showing that the PTFE particles are embedded in and coated by the ethylene methacrylic acid resin to achieve a homogeneous population of toner particles.

EXAMPLE 8

The toner preparation procedure of Example 7 is used with the following exception: the polytetrafluoroethylene used is MP1000 (duPont Corporation). Scanning electron micrographs of MP 1000 have a distinct and different morphology from the PTFE of Example 7, and are small homogeneous smooth particles with a rounded rectangular shape. However, the toner particles from this example (Example 8) look identical to the particles of Control Preparation 4 showing that the PTFE particles are embedded in and coated by the ethylene methacrylic acid resin to achieve a homogeneous population of toner particles.

EXAMPLE 9

The uncharged toners made with PTFE of Example Preparations 1–7 as well as the corresponding Control Preparations without PTFE are diluted to 2.0% solids with Isopar ® L. To a 30 gram sample is added a solution of either Emphos ® D70–30C or Basic Barium Petronate ® (both from Witco Corp., New York, N.Y.) in the amounts shown in Table 1. After equilibrating 1 day, the mobility is measured on an Electrokinetic Sonic Amplitude Instrument (Matec, Inc., Hopkinton, Mass.) Results are given in Table 1. In all cases toners made with PTFE showed higher mobilities than the corresponding control toners without PTFE.

TABLE 1

MOBILITIES OF TONERS

| | Charge Director[1] | Mobility × $10^{10}$ $m^2/Vsec$ |
|---|---|---|
| Control 1 | 200 mg E/g | 0.8 |
| Example 1 | 200 mg E/g | 7.0 |
| Control 2 | 100 mg BBP/g | 1.4 |
| Example 2 | 100 mg BBP/g | 6.4 |
| Control 3 | 200 mg E/G | 1.0 |
| Example 3 | 200 mg E/g | 5.5 |
| Control 4 | 200 mg E/g | 2.6 |
| Example 4 | 200 mg E/g | 7.9 |
| Control 5 | 100 mg E/g | 1.1 |
| Example 5 | 100 mg E/g | 20.4 |
| Control 6 | 40 mg E/g | 9.3 |
| Example 6 | 40 mg E/g | 12.6 |
| Example 7 | 40 mg E/g | 21.7 |

[1]mg charge director/gram toner solids, E = Emphos ®, BBP = Basic Barium Petronate ®.

EXAMPLE 10

The uncharged toners made with PTFE from Example Preparations 1, 2 and 4, as well the corresponding controls without PTFE are diluted with Isopar ® L to 2000 g at 1.0% solids and are charged with either Basic Barium Petronate ® or Emphos ® to a conductivity of 15 pmho/cm after 3 days. Image quality is determined using a Savin 870 photocopier under the following test conditions for a negatively charged toner: development bias set at +250 volts, and transfer corona set at +6.0 kV. Xerox 4024 paper and offset enamel paper are used. Results are given in Table 2. In all cases toners made with PTFE show higher density, improved transfer efficiency and improved resolution.

TABLE 2

IMAGE QUALITY - PERFORMANCE EVALUATIONS OF TONERS

| | | Xerox 4024 Paper | | | Offset Enamel Paper | | |
|---|---|---|---|---|---|---|---|
| | Charge Director | Density | Resol., 1 p/mm | Transfer Efficiency | Density | Resol., 1 p/mm | Transfer Efficiency |
| Control 1 | E | 0.54 | 3.6 | 32% | 0.73 | 4 | 32% |

TABLE 2-continued

IMAGE QUALITY - PERFORMANCE EVALUATIONS OF TONERS

| | Charge Director | Xerox 4024 Paper Density | Resol., 1 p/mm | Transfer Efficiency | Offset Enamel Paper Density | Resol., 1 p/mm | Transfer Efficiency |
|---|---|---|---|---|---|---|---|
| Example 1 | E | 0.78 | 4 | 58% | 0.85 | 4.5 | 58% |
| Control 2 | BBP | 0.19 | 1.6 | 32% | 0.34 | 1.8 | 32% |
| Example 2 | BBP | 0.68 | 4 | 68% | 1.02 | 4.5 | 68% |
| Control 4 | E | 0.85 | 5.6 | 53% | | | |
| Example 4 | E | 1.14 | 5.6 | 75% | | | |

While the invention has been described with reference to particular preferred embodiments, the invention is not limited to the specific examples given, and other embodiments and modifications can be made by those skilled in the art without departing from the spirit and scope of the invention.

What is claimed is:

1. A liquid electrostatic developer comprising a liquid carrier and toner particles comprising a halogenated resin partially coated with a thermoplastic resin.

2. The developer of claim 1, wherein said toner particles further comprise at least one member selected from the group consisting of a colorant and a charge adjuvant.

3. The developer of claim 1, wherein said liquid carrier is an isoparaffinic hydrocarbon.

4. The developer of claim wherein said halogenated resin is a fluorinated resin.

5. The developer of claim 4, wherein said fluorinated resin is selected from the group consisting of polytetrafluoroethylene, poly(tetrafluoroethylene-co-chlorotrifluoroethylene), poly(tetrafluoroethylene-co-hexafluoropropylene, poly(tetrafluoroethylene-co-perfluoroalkylether), poly(tetrafluoroethylene-co-ethylene), polyvinylidinefluoride, polychlorotrifluoroethylene, poly(chlorotrifluoroethylene-co-ethylene) and polyvinylfluoride.

6. The developer of claim 4, wherein said fluorinated resin is polytetrafluoroethylene.

7. The developer of claim 1, wherein said halogenated resin is present in an amount from about 10 to about 70 percent by weight of the toner particles.

8. The developer of claim 1, wherein said halogenated resin is present in an amount from about 20 to about 50 percent by weight of the toner particles.

9. The developer of claim 1, wherein said thermoplastic resin is selected from the group consisting of ethylene vinyl acetate copolymers and copolymers of ethylene and an $\alpha$-$\beta$-ethylenically unsaturated acid selected from the group consisting of acrylic acid and methacrylic acid.

10. The developer of claim 2, wherein said charge adjuvant is selected from the group consisting of polyhydroxy compounds, aminoalcohol compounds, polybutylene/succinimides, metallic soaps and aromatic compounds.

11. The developer of claim 2, wherein said toner particles further comprise a charge director selected from the group consisting of lecithin, barium petroleum sulfonate, and sodium salts of phosphated mono- and dicglycerides with unsaturated and saturated acid substituents.

12. The developer of claim 1, wherein said toner particles have an average particle size by area of less than 10 $\mu$m.

13. The developer of claim 1, wherein said toner particles have an average particle size by area of less than 10 $\mu$m.

14. A liquid electrostatic developer prepared by a process comprising the steps of:

melt blending a halogenated resin and thermoplastic resin to form a mixture; and grinding said mixture at a cold temperature to form toner particles in the presence of a non-polar liquid.

15. The developer of claim 14, wherein said process further comprises the step of adding to said mixture at least one member selected from the group consisting of a colorant, a charge director and a charge adjuvant.

16. The developer of claim 14, wherein said non-polar liquid is an isoparaffinic hydrocarbon.

17. The developer of claim 14, wherein said halogenated resin is a fluorinated resin.

18. The developer of claim 14, wherein said thermoplastic resin is selected from the group consisting of ethylene vinyl acetate copolymers and copolymers of ethylene and an $\alpha$-$\beta$-ethylenically unsaturated acid selected from the group consisting of acrylic acid and methacrylic acid.

19. The developer of claim 15, wherein said charge adjuvant is selected from the group consisting of polyhydroxy compounds, aminoalcohol compounds, polybutylene/succinimides, metallic soaps, and aromatic compounds.

20. The developer of claim 14, wherein said halogenated resin is present from about 10 to about 70 percent by weight of the toner particles.

21. The developer of claim 14, wherein said halogenated resin is present from about 20 to about 50 percent by weight of the toner particles.

22. The developer of claim 14, wherein said toner particles have an average particle size by area of less than 30 $\mu$m.

23. The developer of claim 14, wherein said toner particles have an average particle size by area of less than 10 $\mu$m.

24. The developer of claim 1, wherein said halogenated resin is selected from the group consisting of chlorinated polyethylene, chloro-sulfonated polyethylene, polyvinylcholoride and copolymers such as polyvinylchloride-co-vinyl acetate, polyvinylchloride-co-ethylene, polyvinylchloride-co-propylene, polyvinylchloride-co-acetate and chlorinated polyvinylchloride.

* * * * *